US008353500B2

(12) United States Patent
Walpole et al.

(10) Patent No.: US 8,353,500 B2
(45) Date of Patent: Jan. 15, 2013

(54) PRE-MANUFACTURED FENCE SYSTEM

(75) Inventors: Herbert L. Walpole, Cypress, TX (US); Loren R. Hill, Houston, TX (US); Joel W. Bolin, Hempstead, TX (US)

(73) Assignee: Joel W. Bolin, Hempstead, TX (US)

( * ) Notice: Subject to any disclaimer, the term of this patent is extended or adjusted under 35 U.S.C. 154(b) by 710 days.

(21) Appl. No.: 12/221,326

(22) Filed: Aug. 1, 2008

(65) Prior Publication Data

US 2010/0025648 A1 Feb. 4, 2010

(51) Int. Cl.
*E04H 17/00* (2006.01)

(52) U.S. Cl. ..... 256/65.08; 256/65.03

(58) Field of Classification Search ..... 256/19, 256/21, 24, 59, 66, 68, 69, 65.02, 65.03, 256/65.04, 65.05, 65.06, 65.07, 653.08, 65.08
See application file for complete search history.

(56) References Cited

U.S. PATENT DOCUMENTS

| | | | | | |
|---|---|---|---|---|---|
| 3,037,593 | A | * | 6/1962 | Webster | 256/24 |
| 3,506,243 | A | * | 4/1970 | Seiler | 256/59 |
| 3,879,017 | A | * | 4/1975 | Maxcy et al. | 256/65.08 |
| 4,390,165 | A | * | 6/1983 | Murdock | 256/24 |
| 4,586,697 | A | * | 5/1986 | Tornya | 256/59 |
| 4,623,128 | A | * | 11/1986 | Dutch et al. | 256/65.08 |
| 5,200,240 | A | * | 4/1993 | Baker | 256/59 |
| 5,255,897 | A | * | 10/1993 | Pepper | 256/24 |

* cited by examiner

*Primary Examiner* — Michael P Ferguson
(74) *Attorney, Agent, or Firm* — The Matthews Firm

(57) ABSTRACT

A pre-manufactured fence system is constructed of horizontal rails, posts that form a fence field surface or and area and pickets or panels that complete the field. The posts and rails are hollow extruded members of polymer or metal material that are interconnected by bracket members that fit within bracket compartments of the rails. Bracket bar members are connected with the bracket members and are received within key-ways of the posts to properly position the rails with respect to the posts. The extruded components perform fence component positioning and establish pre-determined dimensioning and locations of the accompanying parts and pieces of the complete fence system and provide for component attachment that is not visible when the fence installation is completed.

12 Claims, 4 Drawing Sheets

PRE-MANUFACTURED FENCE SYSTEM

BACKGROUND OF THE INVENTION

1. Field of the Invention

The present invention generally concerns fencing systems and fence materials such as are typically employed in connection with domestic properties and light industrial properties for purposes of protection and for ornamental enhancement. More particularly this invention relates generally to a pre-manufactured fence system which will accept many different compositions to fill the interior "field area" of the fence. More specifically, the pre-manufactured fence system of the present invention utilizes extruded components that both perform for their recommended functions as well as establish pre-determined dimensioning and locations of the accompanying parts and pieces of the complete fence system while eliminating virtually all needs for any visual mechanical attachments.

2. Description of the Prior Art

Most fence systems being installed at the present time employ simple structural members that are held in assembly by any of a number of suitable fasteners. Wood fencing typically employs wood posts that are maintained in place by concrete. Support members can be fixed to the wood posts by means of screws, bolts, nails or any other suitable type of fasteners. Transverse structural members for picket support have end portions that are positioned by the support members, the end portions being secured both to the posts and to the support members by nails, screws, bolts or any other suitable type of fasteners. Picket members, typically composed of wood or polymer material are fixed by nails or screws to the transverse or horizontal structural members. In many cases metal vertical posts are substituted for the wood fence posts, but in general the fence components and installation procedure are much the same. In time the wood components, including posts, horizontal structural picket support members and wood pickets will be deteriorated by weather and the fence structure will be in need of replacement. Wood fence systems of this nature are also quite susceptible to damage by wind load.

More recently, pre-manufactured fence systems have been developed for use particular in the residential environment, but also in the commercial environment. These pre-manufactured fence systems are much like conventional wood fence systems, except that the fence components are composed of a polymer material. The various components of the pre-manufactured fence systems are assembled in conventional manner via the use of common fasteners such as screws and bolts. When the fence system is completed the fasteners are typically quite visible. Moreover, in the event electrical wiring is employed in conjunction with the fence system, such as for fence supported lighting or for fence gate operation, it must be located externally of the components of the fence or buried in the ground along the fence line. In this case, and to satisfy electrical codes, the wiring must be protected by electrical conduit or it is subject to damage by exposure to the environment. And when electrical conduit of this nature is employed the result is often a fence of unsightly appearance.

SUMMARY OF THE INVENTION

It is the primary feature of the present invention to provide a pre-manufactured fence system that can be erected by virtually anyone with limited mechanical ability as the main benefit of the design.

It is an important feature of the present invention to provide a novel pre-manufactured fence system having components that are maintained in assembly by the interlocking or interfitting relation of fence components, so that fasteners and other retainer devices are hidden from view.

It is another feature of the present invention to provide a novel pre-manufactured fence system having components that are designed for fence installation and are also designed to permit the use of internal electrical wiring for fence lighting and for electrical gate operation.

It is also a feature of the present invention to provide a novel pre-manufactured fence system having hollow posts composed of extruded polymer or metal material, closed with a removable top cap, and defining an internal passage through which objects such as lighting conduits, water supply conduits or the like may extend to provide a multi-purpose fence system.

Another feature of the present invention is to provide post members having an extruded slot which allows for the fencing material to be placed into it, eliminating the need for any trim materials or termination edges.

Briefly, the pre-manufactured fence system of the present invention is comprised of substantially vertical structural members identified as posts that have bottom portions thereof secured in the ground or fixed in any suitable manner to any support structure, such as a deck, masonry platform or patio, concrete porch, for example. The posts are of tubular form thus defining an internal passage. The posts and other structural members of the fence system can be extruded in aluminum or other metal and can be manufactured from a wide range of materials including steel, suitable polymer materials and composites of metal and polymers. The components can be finished with a paint or powder coating process acceptable to the manufacturer or end user. The actual members can be compromised in size and density to satisfy the particular requirements of the user and the distance between posts can then be reduced to allow for changes in the density of the selected materials. Actual sizing of the openings within the extruded parts can vary in dimension to accommodate many different thicknesses of materials that are utilized in present day fence building.

All components of the pre-manufactured fence system are comprised of certain design elements that both perform for their intended uses and limit the potential variables typically experienced for such a product. Pre-defined openings, together with accompanying elements, minimize the need for professional installation. The finish materials provide for a clean and virtually flawless installation process and a finished product that requires virtually no maintenance and thus provides many years of essentially trouble-free service.

The extruded post member of the pre-manufactured fence system has certain design characteristics which perform both to satisfy the structural wind load requirements and commencing the overall design of the installation process. Depending upon which materials are used to fill the field of the system, alternate posts, boasting different dimensions of widths and depths of the respective openings within the posts, are available to accommodate these material thickness variables.

The post or column defines an extruded slot key-way which allows a bar shaped element to be placed into it to establish the location of the horizontal rail members. This bar element is produced in lengths pre-determined and placed incrementally to establish the locations of the horizontal members and thus determining the lengths of the pickets or other panel members. This bar shaped element is attached to a bracket or clip which aligns the horizontal rail members to the vertical posts and additionally functions to prevent raising or lowering of the horizontal member after fence installation has been completed. This bracket or clip also provides the location for blind mechanical attachment if desired. The bracket or clip has a screw boss to which the bar element is mounted before the bracket is inserted into a bracket receptacle of one of the horizontal rail members.

The top, intermediate and bottom horizontal fence rails of the pre-manufactured fence system define at least one extruded slot which receives the ends of picket members or other fencing material and eliminating the need for any trim materials or termination edges. Each of the rails is formed by extrusion and presents opposed side walls of any desired geometric configuration. Extruded diagonal wall members are located within the hollow rails and serve to connect the two side walls. This diagonal internal wall connection not only adds structural integrity necessary for the system to function but the angle also provides for dimensional flexibility of the pickets or panels elements selected for the finished product. Preferably, the horizontal member is extruded in the form of a vertical "ellipse" profile to add horizontal, vertical and wind-shear support thus eliminating the need for an additional intermediate structural member.

An opening in the horizontal rail member can be extruded to the dimensional thickness of particular pickets or panels selected as the finish panel product. This opening extruded to the exact and necessary increment provides the necessary friction in order to hold the picket or panel elements in place during the installation process and prior to the horizontal member being placed on top to secure the pickets or panel below. To complete the installation, the top rail is installed, with the upper ends of the pickets or panels received by its downwardly opening picket slot and with its closed upper wall positioned to exclude rainwater and other contaminants from the hollow interior of the rails. The closed upper wall also provides a finish to the horizontal rail member and reduces potential water infiltration. The upper horizontal rail is secured in place by installing a screw in the bracket-bar at the top of the post or column to which, when a post cap is installed, will cover and secure the screw attachment.

To complete the panel installation, the post cap is installed on the top of the post and is "snapped" into place. Edges of the cap serve to cover the screw attachment so that the mechanical attachment of the top rail to the post is not visible when installation of the pre-manufactured fence system has been completed. This final cap process finalizes the installation process and confirms the "no mechanical attachments visible" representation of the completed fence system.

The pre-manufactured fence system is designed to accept a wide variety of different compositions present invention relates generally to a to fill the interior "field surface" of the fence. More particularly, the present invention utilizes extruded components that both perform for their recommended functions as well as establish pre-determined dimensioning and locations of the accompanying parts and pieces of the complete system while eliminating virtually all needs for any visible mechanical attachments. The structural members of the system can be extruded in aluminum or metal. The components can be finished with a paint or powder coating process acceptable to the manufacturer or end user. The actual members can be compromised in size and density to satisfy the particular requirements of the user and the distance between posts can then be reduced to allow for this reduction. Actual sizing of the openings within the extruded parts can fluctuate in dimension to accommodate many different thicknesses of materials that are utilized in fence building today.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

IN THE DRAWINGS

Figure 1:
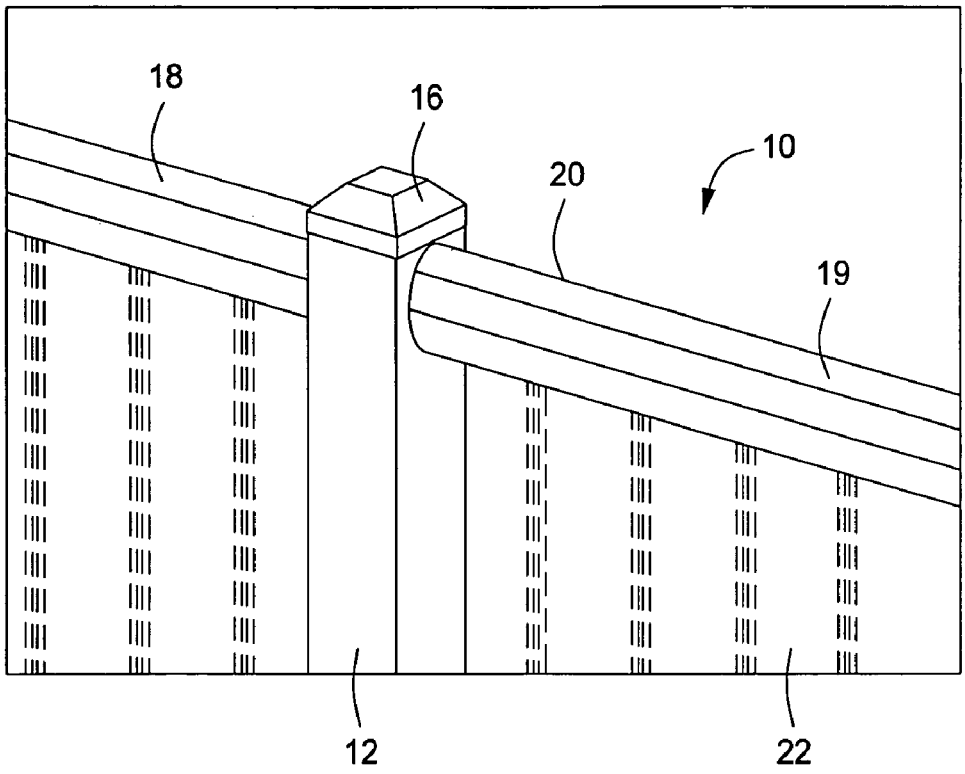
Figure 2:
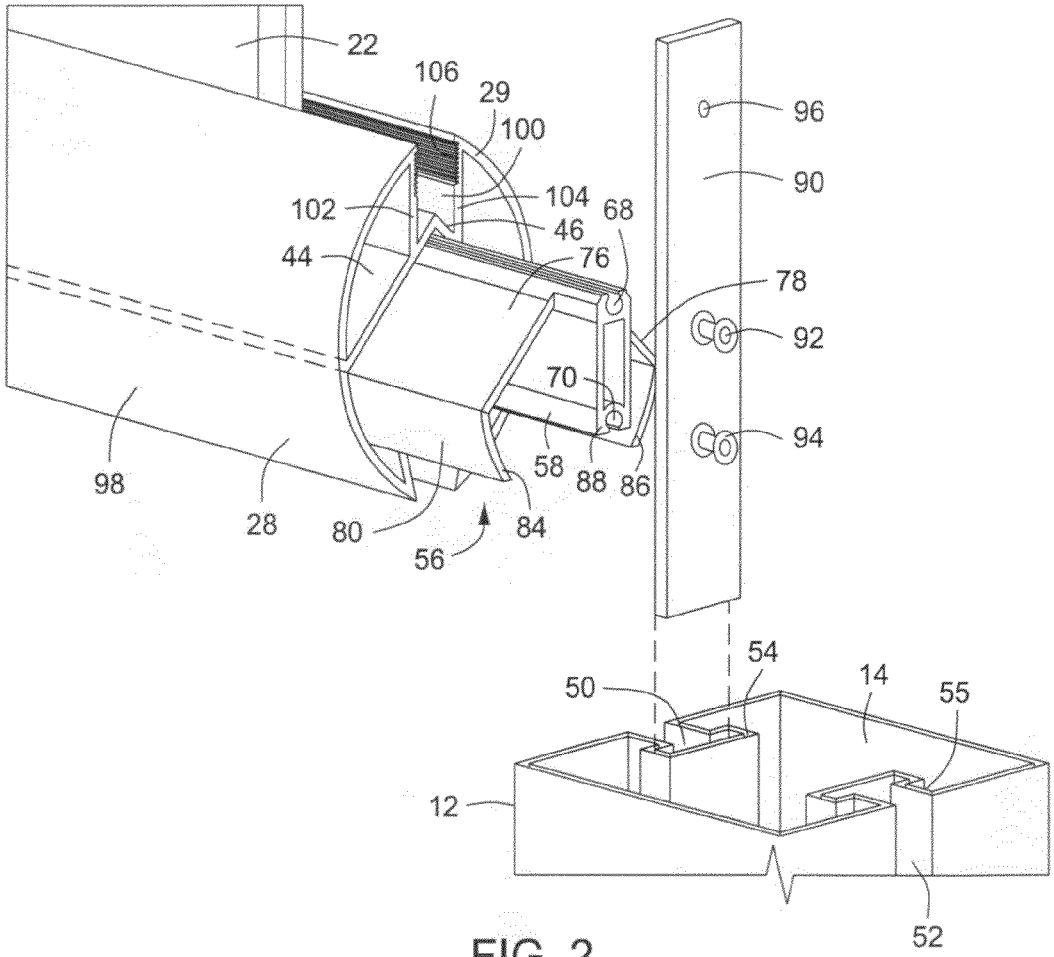
Figure 3:
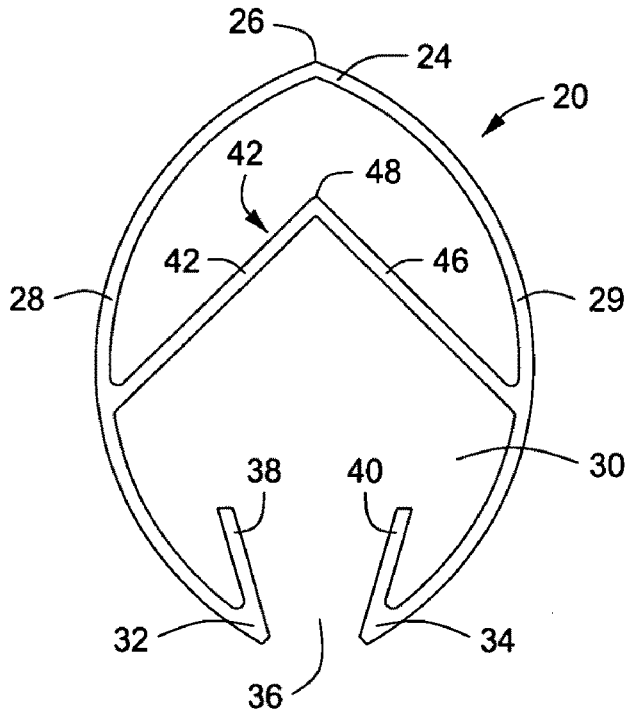
Figure 4:
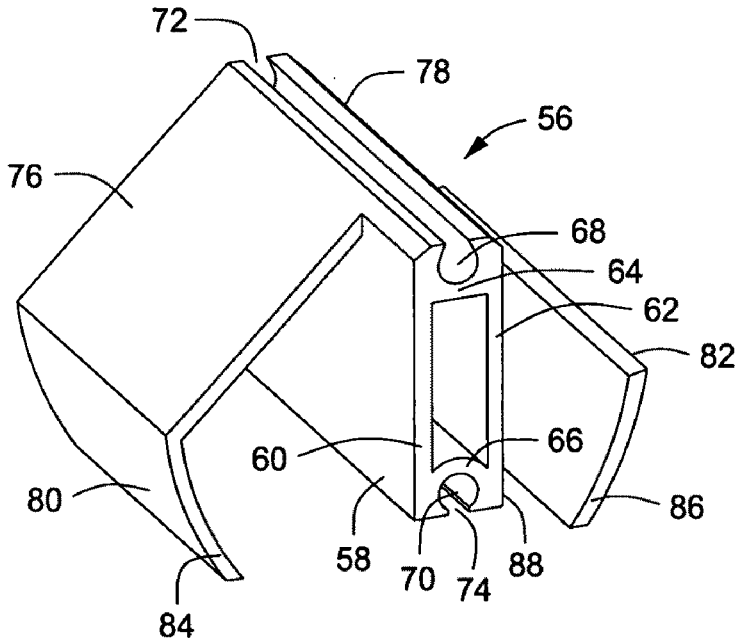
Figure 5:
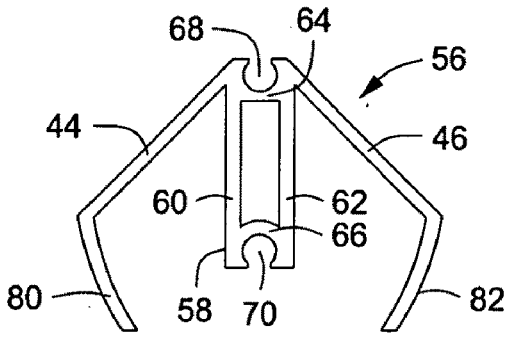

FIG. 1 is a partial isometric illustration showing a pre-manufactured fence system constructed according to the principles of the present invention, particularly showing a fence post, top rail and pickets and representing the preferred embodiment of the invention;

FIG. 2 is an exploded isometric illustration showing a portion of a fence post and its vertical pocket and key-way and showing an intermediate rail of the pre-manufactured fence system of FIG. 1 and further showing a bracket member and bracket bar for connecting the intermediate rail with the post and further showing a picket member in assembly with the intermediate rail;

FIG. 3 is an end view of the top rail of the pre-manufactured fence system of FIGS. 1 and 2;

FIG. 4 is an isometric illustration of the connection bracket of FIG. 2;

FIG. 5 is an end view of the connection bracket of FIG. 2, showing the geometric form of the bracket.

Figure 6:
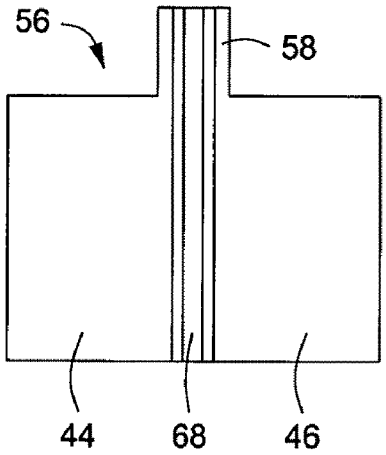
Figure 7:
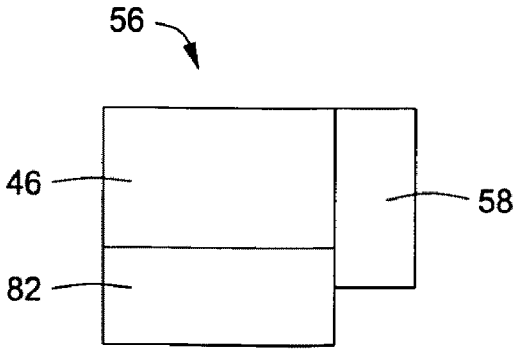

FIG. 6 is a plan view of the connection bracket of FIGS. 2 and 4;

FIG. 7 is a side elevation view of the connection bracket of FIGS. 2 and 4.

DETAILED DESCRIPTION OF PREFERRED EMBODIMENT

Referring now to the Drawings and first to FIGS. 1 and 2, a pre-manufactured fence system embodying the principles of the present invention is shown generally at 10 and has a generally vertically oriented tubular fence post 12 which is shown to be of rectangular cross-sectional configuration and defines an interior space or passage 14 within the hollow post as shown in FIG. 2. However, it is to be understood that the fence post may have any suitable cross-sectional configuration, including circular, oval, octagonal, etc., without departing from the spirit and scope of this invention. The post may be supported with its lower end concreted within the ground or its lower end may be fixed in any suitable manner to any support structure, such as a deck, masonry platform or patio, concrete porch, for example.

A top cap 16, also preferably composed of polymer material, provides a weather tight cover for the upper end of the post and provides protection for any object, such as electrical wiring for example that is located within the interior space or passage 14 of the hollow tubular post. The top cap is preferably composed of a molded material, including molded metal, rubber, fiberglass or any of a number of other materials.

If desired, the top cap may be in the form of a mounting base for a fence mounted electrical or flammable gas energized lamp device.

As mentioned above, the primary feature of the present invention is to provide a pre-manufactured fence system that can be erected by virtually anyone having even limited mechanical ability. This feature or benefit is provided by the unique design of the various components of the fence system. And it is intended to be borne in mind that the various visible components of the fence system may be designed to emulate the general appearance of a fence system incorporating wood rails and pickets.

Top rail sections, such as shown at 18 and 19, are defined by a top rail structure 20 of elliptical cross-section and are connected with the post 12 as will be described in detail below and picket members 22, also composed of polymer material, have upper and lower ends there located and restrained within picket retainer grooves of the top rail, one or more intermediate rails and a bottom rail. Preferably the top rail is composed of extruded material that is provided in various standard lengths and can be easily cut to desired lengths at a fence installation site.

The top rail 20 of the pre-manufactured fence system, shown by top rail sections 18 and 19 in FIG. 1, is further identified by the cross-sectional configuration of FIG. 3, and is of tubular form, being defined by a closed upper wall portion 24 which in the preferred embodiment, defines a top center-line 26. It should be borne in mind however, that the upper closed wall portion may be of partially cylindrical configuration or it may be flat or nearly flat, depending on the top rail design that is preferred for any particular fence structure. The top rail 20 and other rails of the pre-manufactured fence system define curved side wall portions 28 and 29 that are preferably defined by inner and outer radii and establish an internal picket and bracket compartment 30. For example, the preferred embodiment has a wall thickness that is defined by an inner radius of 1.615 inches and an outer radius of 1.695 inches. These particular radius dimensions, however, are merely intended to describe the preferred embodiment and are not to be taken as limiting the present invention in any manner whatever. The radii will be determined largely by the top rail wall thickness that is appropriate for a top rail of desired length and is determined also by the material from which the top rail is extruded. The curved side walls 28 and 29 generally represent the walls of an ellipse when viewed in cross-section and essentially intersect at their upper portions to define a closed top wall and top center-line 26. The curved, elliptical configuration of the side walls of the preferred embodiment present an exterior fence surface that presents no abrupt shoulders that would allow a person to easily climb the fence and gain entry to a secured area within the fence boundary.

Fencing of many different configurations may be designed within the spirit and scope of the present invention. It should be borne in mind that the side wall structure of the top rail may be of other than curved configuration if desired for a fence construction of a particular design. The top rail side walls may have the form of vertically oriented substantially flat walls or may be defined as portions of an octagon if desired to provide a fence structure of a particular design. The side wall portions and top wall portion of the top rail may be of any desired decorative configuration.

Bottom edge portions 32 and 34 of the curved side walls 28 and 29 are spaced to define a picket slot 36 through which the ends of picket members 22 extend into the internal picket and connection bracket compartment 30. The picket slot 36 is also defined in part by the lower ends of upstanding internal wall members 38 and 40 that are integral with the bottom edge portions 32 and 34. These upstanding internal wall members are oriented in upwardly diverging relation, being oriented at approximately 15° from the vertical, thus defining an included angle of about 30°. This diverging wall relationship permits picket members to be inserted through the slot 36 while oriented at an angle up to 15° from the vertical during fence assembly. The internal wall members also enhance the structural integrity of the top rail structure.

An internal transverse wall generally shown at 42 is defined by extruded diagonal members 44 and 46 which are located within the top rail member and connect the two curved side walls 28 and 29 of the horizontal top rail member 20. This diagonal internal wall connection not only adds structural integrity necessary for the system to function but the angle also provides for dimensional flexibility of the pickets or panel elements 22 selected for the finished fence product. Additionally, the horizontal rail member 30 is essentially extruded in the form a vertical "ellipse" profile to add horizontal, vertical and wind-shear support thus eliminating the need for an additional intermediate structural member. The internal transverse wall 42 is defined by substantially straight angulated internal wall sections 44 and 46 that intersect at an apex 48 that are integral with one another and with respective side walls 28 and 29 so that the rail 20 is a single extruded member. The substantially planar internal wall sections 44 and 46 are preferably oriented at an included angle of about 90° and provide efficient resistance to wind shear and other forces that might otherwise cause twisting and lateral bending of the top rail.

It is desirable to provide a pre-manufactured fence system having posts and rails that are interconnected in a manner ensuring that fasteners and other connecting members are not visible when a fence installation is completed. This feature is achieved within the spirit and scope of the present invention as will be explained in detail. Referring to FIG. 2, the fence post 12, regardless of its cross-sectional configuration, defines at least one key-way 50 having a bracket slot 52 that opens outwardly. The key-way 50 is shown in FIG. 2 to be of generally rectangular configuration, being formed by key-way wall structure 54 and by the wall structure 55 that forms the bracket slot 52 which are extruded integral with the post or column structure 12. It should be borne in mind however, that the key-way may have the form of a dove-tail or any other undercut geometry without departing from the spirit and scope of the present invention.

A connection bracket member, shown generally at 56 in FIGS. 2 and 3-7 is also an extruded member that is cut to desired length for connection of the fence rails to the posts. A plurality of properly sized connection bracket members will typically be manufactured and provided in kit form along with other components of the pre-manufactured fence system. If desired, however, a length of extruded connection bracket material may be provided so that it can be cut to selective lengths as desired by fence installation personnel. The connection bracket 56 incorporates a central, generally rectangular boss 58, also referred to as a screw boss or bracket bar mount. The boss 58 is defined by spaced parallel structural walls 60 and 62 that are interconnected by intermediate walls 64 and 66. It should be noted that the upper intermediate wall 64 is generally in the form of a horizontal flat wall while the lower intermediate wall 66 is of curved cross-sectional configuration. It should be borne in mind that these intermediate walls of the boss can have other configurations. Upper and lower portions of the spaced parallel structural walls 60 and 62 define upper and lower screw receptacles 68 and 70 formed by upper and lower slots 72 and 74 extending along the length of the boss 58.

The connection bracket member 56 is designed to be received in close-fitting relation within the picket and connection bracket compartment 30. Lateral support wall members 76 and 78 are integral with and extend laterally and downwardly in angular relation from the upper portion of the central generally rectangular boss 58. The lateral support wall members 76 and 78 have substantially the same 90° angular relation as the substantially planar internal wall sections 44 and 46 of the top rail member and when installed within the picket and connection bracket compartment 30, are positioned in engaging or juxtaposed relation with the internal wall sections 44 and 46. The lateral support wall members also have integral lower curved wall sections 80 and 82 having a curvature closely matching the curvature of the lower portions of the curved side walls 28 and 29 of the rail structure. The lateral support wall members 76 and 78 and the integral lower curved wall sections 80 and 82 define forward edges 84 and 86, with the forward end 88 of the rectangular boss projecting beyond the forward edges as shown clearly in the isometric illustrations of FIGS. 2, 4, 6 and 7.

Regardless of the character of rail, i.e., top, intermediate or lower, a bracket bar member 90 is mounted to the forward end of the rectangular boss or bracket bar mount 58 by means of screws or other suitable fasteners 92 and 94 which are threaded into the respective upper and lower screw receptacles 68 and 70. With the bracket bar 90 mounted to the rectangular boss 58, the rail and bracket bar are moved linearly, causing the bracket bar to enter the key-way 50 and causing the rectangular boss 58 to move through the slot 52 until the rail member is properly positioned with respect to the post 12. At this point the bracket bar is secured at the desired position by a screw or other suitable fastener extending through one or more fastener holes 96 of the bracket bar and being threaded into the wall structure of the key-way. This fastener will be hidden from view since it will be located within the key-way. A fastener installation tool such as a screw driver will be extended through the slot 52 to drive the bracket bar retaining fastener. One or more sections of bracket bar material may be fixed to the post structure within the key-way 50 to serve as a stop member for desired location of an intermediate or lower horizontal rail member with respect to the post member.

The rail member 98, shown in FIG. 2, is an intermediate rail, which differs from the top rail 20 of FIGS. 1 and 3 only in that an upwardly opening horizontal pocket or picket slot 100 is defined by upper portions of the walls 44 and 46 and by upstanding walls 102 and 104. The walls 102 and 104 may define multiple horizontally oriented sharp edged serrations 106 that provide resistance to movement of the picket members 22 within the picket slot and assist with retention of the pickets within the field that is defined by the posts and rails. The an upwardly opening picket slot 100 is preferably sized to provide a friction fit with the picket or panel members and the serrated internal surfaces 106 essentially grip the ends of the pickets or panels and maintain them in place until the top rail member is installed over the top edges of the pickets or panels.

Benefits of the Pre-Manufactured Fence System of the Present Invention:

1. The pre-manufactured fence system design minimizes the need for more qualified installers to install the system. The unique design of the various fence components ensures the ease of fence assembly installation to achieve completed fences of pleasing aesthetic appearance.

2. Pre-manufactured design elements minimize the time period that is required for fence installation. There is little need for the otherwise time consuming activities of cutting and fitting fence components during fence installation.

3. The unique horizontal rail member design minimizes the capability of an intruder to "climb over the completed fence" thus making the pre-manufactured fence system of the present invention a much safer and more significantly secure, as compared with conventional fences.

4. This pre-manufactured fence system provides effectively for flexibility of extruded profiles and thus provide for the virtually "limitless" ability to utilize alternative materials, if desired, to complete the "field" of the fence system giving a much broader range of material size, color, texture and etc. from which to choose.

5. The pre-manufactured fence system of the present invention provides a water-proof system design coupled with the equally parallel weather-proof field panel materials provides for a fence system to look new longer and remain straight and true and provide the "ultimate level of performance" for many years of trouble free service.

6. In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

We claim:

1. A pre-manufactured fence system, comprising:

extruded hollow fence post members each having wall structure defining at least one key-way located along the length thereof;

extruded fence rail members each being of substantially hollow construction and having ends defining connection bracket receiving compartments, said extruded fence rail members each defining opposed side walls and defining at least one of an upper or lower fence picket slot extending along the length thereof;

said side walls of each said fence rail member having at least one of spaced upper or lower ends to define a respective one of said upper or lower slots to permit insertion of lower or upper ends of picket and panel members through said slot;

connection bracket key members having portions thereof located within said connection bracket receiving compartments and defining a bracket bar mount;

at least one bracket bar member being secured to said bracket bar mount by at least one fastener and being received within said key-way, said at least one fastener being located within said key-way and securing said bracket bar at a desired position within said key-way; and an internal transverse wall extending substantially the length of each of said extruded rail members and being connected with each of said opposed side walls and being oriented to enhance the structural integrity of said extruded fence rail members and resist twisting and bending of said fence rail member by wind loads and other forces, wherein the internal transverse wall forms an upper wall of said connection bracket receiving compartment and matingly engages said connection bracket key member.

2. The pre-manufactured fence system of claim 1, comprising:

said side walls of said extruded fence rail members being of curved geometry and intersect to define a narrow upwardly facing edge and minimizing the potential for persons to climb over the fence system.

3. The pre-manufactured fence system of claim 1, comprising:

said internal transverse wall being defined by substantially flat internal wall sections being connected with one another and being oppositely inclined within said extruded rail member and defining an angular relationship with one another.

4. The pre-manufactured fence system of claim 1, comprising:

said side walls of each of said extruded fence rail members having spaced lower ends defining a lower said fence picket slot; and upstanding internal wall members each being connected with one of said opposed side walls and extending in spaced relation within said extruded fence rail members and being positioned in upwardly diverging relation to permit insertion of upper ends of picket and panel members through said lower slot and into said fence rail member.

5. The pre-manufactured fence system of claim 1, comprising:

said bracket bar mount being defined by said connection bracket members and having at least one fastener receptacle; and a fastener member extending through said bracket bar and engaging within said fastener receptacle and retaining said bracket bar member and said connection bracket member in substantially fixed assembly.

6. The pre-manufactured fence system of claim 1, comprising:

a generally rectangular structure projecting toward a post member from said connection bracket member and having an end portion defining said bracket bar mount;

said generally rectangular structure having spaced generally parallel substantially vertically oriented walls interconnected by upper and lower intermediate walls and having an end portion thereof defining said fastener receptacles; and fastener members extending through said bracket bar and into said fastener receptacles and securing said bracket bar and said connection bracket member in substantially fixed assembly with said generally rectangular structure.

7. The pre-manufactured fence system of claim 1, comprising:

said opposed side walls of said extruded fence rail members being of curved configuration and together defining an elliptical cross-sectional fence rail configuration.

8. A pre-manufactured fence system, comprising:

extruded hollow fence post members each having wall structure defining at least one key-way located along the length thereof;

extruded fence rail members of substantially hollow construction having opposed side walls and defining top and bottom rail structure and having at least one of an upper or lower picket and panel receiving slot extending along the length thereof, said extruded fence rail members having ends defining connection bracket receiving compartments;

said side walls of each said fence rail member having at least one of spaced upper or lower ends to define a respective one of said upper or lower slots to permit insertion of lower or upper ends of picket and panel members through said slot;

an internal transverse wall being located within said extruded fence rail members extending substantially the length of said extruded fence rail members being connected with each of said side walls and being oriented to enhance the structural integrity and resist twisting and bending of said extruded fence rail members by wind loads and other forces;

connection bracket members having portions thereof located within said connection bracket receiving compartments and each defining a bracket bar mount, wherein the internal transverse wall forms an upper wall of said connection bracket receiving compartments and matingly engages said connection bracket key member;

at least one bracket bar member being mounted in substantially fixed relation to said bracket bar mount and being received within said key-way; and at least one fastener being located within said key-way extending through said bracket bar and into said wall structure of said extruded hollow fence post and securing said bracket bar at a desired position within said key-way.

9. The pre-manufactured fence system of claim 8, comprising:

said opposed side walls of said extruded fence rail members being of curved geometry and intersecting along an upwardly facing longitudinal line and defining a narrow edge minimizing the potential for persons to climb over the fence system; and said internal transverse wall being defined by substantially flat internal wall sections being connected with one another and being disposed in oppositely inclined relation within said extruded rail member and defining an angular relationship with one another;

said opposed side walls of each of said extruded fence rail members having spaced lower portions defining a lower said picket and panel receiving slot; and upstanding internal wall members extending upwardly from each of said side walls into said extruded fence rail member and being positioned in upwardly diverging relation permitting insertion of upper ends of picket and panel members through said lower picket and panel receiving slot and into said extruded fence rail member.

10. The pre-manufactured fence system of claim 9, comprising:

said bracket bar mount being defined by said connection bracket member and having at least one fastener receptacle; and at least one fastener member extending through said bracket bar and engaging within said fastener receptacle and retaining said bracket bar member and said connection bracket member in substantially fixed assembly.

11. The pre-manufactured fence system of claim 8, comprising:

a generally rectangular structure projecting toward a post member from said connection bracket member and having an end portion defining said bracket bar mount;

said generally rectangular structure having spaced generally parallel substantially vertically oriented walls interconnected by upper and lower intermediate walls and having an end portion thereof defining fastener receptacles; and at least one fastener member extending through said bracket bar and securing said bracket bar and said connection bracket member in substantially fixed assembly.

12. A fence system, comprising:

extruded hollow fence post members each having wall structure defining at least one key-way located along the length thereof;

extruded fence rail members each being of substantially hollow construction and having ends defining connection bracket receiving compartments, said extruded fence rail members each defining opposed side walls and defining at least one an upper or lower fence picket slot extending along the length thereof;

said side walls of each said fence rail member having at least one of spaced upper or lower ends to define a respective one of said upper or lower slots to permit insertion of lower or upper ends of picket and panel members through said slot;

connection bracket key members having portions thereof located within said connection bracket receiving compartments and defining a bracket bar mount;

at least one bracket bar member being secured to said bracket bar mount by at least one fastener and being received within said key-way, said at least one fastener being located within said key-way and securing said bracket bar at a desired position within said key-way;

each of said extruded fence rail members having an internal transverse wall extending substantially along the length of said extruded fence rail members and being connected with each of said side walls and being oriented to resist enhancing the structural integrity of said extruded fence rail members and resisting twisting and bending of said fence rail member by wind loads and other forces, wherein the internal transverse wall forms an upper wall of said connection bracket receiving compartments and matingly engages said connection bracket key member;

said side walls of each of said extruded fence rail members having spaced lower ends defining a lower said fence picket slot; and upstanding internal wall members each being connected with one of said opposed side walls and extending in spaced relation within said extruded fence rail members and being positioned in upwardly diverging relation to permit insertion of upper ends of picket and panel members through said lower slot and into said fence rail member.

* * * * *